United States Patent [19]

Crane et al.

[11] 3,999,616

[45] Dec. 28, 1976

[54] METHOD AND APPARATUS FOR ESTABLISHING THE DRILLING LINE OF AN OVERHEAD BORING MACHINE

[75] Inventors: Clayton H. Crane, Mercer Island; Hans A. Adami, Vashon, both of Wash.

[73] Assignee: The Robbins Company, Seattle, Wash.

[22] Filed: Feb. 3, 1975

[21] Appl. No.: 546,604

[52] U.S. Cl. ..... 173/32; 52/295; 173/36; 173/42; 248/23; 299/31

[51] Int. Cl.[2] ..... E21D 1/06; E21C 11/00

[58] Field of Search ..... 299/31; 173/32, 34, 173/36, 28, 43, 42, 44; 175/94, 122; 52/295; 248/23

[56] References Cited

UNITED STATES PATENTS

| | | | |
|---|---|---|---|
| 2,716,019 | 8/1955 | Shacikoski | 173/36 X |
| 3,220,494 | 11/1965 | Cannon et al. | 173/43 X |
| 3,460,638 | 8/1969 | Millsapps, Jr. | 173/34 X |
| 3,604,754 | 9/1971 | Emden | 175/94 X |
| 3,659,661 | 5/1972 | Young et al. | 175/122 X |
| 3,830,318 | 8/1974 | Busby et al. | 175/122 |
| 3,905,426 | 9/1975 | Williams | 299/31 X |

FOREIGN PATENTS OR APPLICATIONS

| | | | |
|---|---|---|---|
| 1,081,845 | 5/1960 | Germany | 173/32 |

*Primary Examiner*—Ernest R. Purser
*Assistant Examiner*—William F. Pate, III
*Attorney, Agent, or Firm*—Graybeal, Barnard & Uhlir

[57] ABSTRACT

A bedplate is rigidly affixed relative to the tunnel floor and includes a centrally disposed shaft extending upwardly therefrom. A rotatable base member is mounted on the bedplate for rotation about the central shaft. A boring machine adapted to bore upwardly is secured to the rotatable base member. The boring machine is swung upwardly along a selected arc of vertical circle and the base member is rotated to a selected azimuth. Following rotation, the rotatable base member is itself rigidly affixed relative to the tunnel floor.

22 Claims, 13 Drawing Figures

Fig. 7
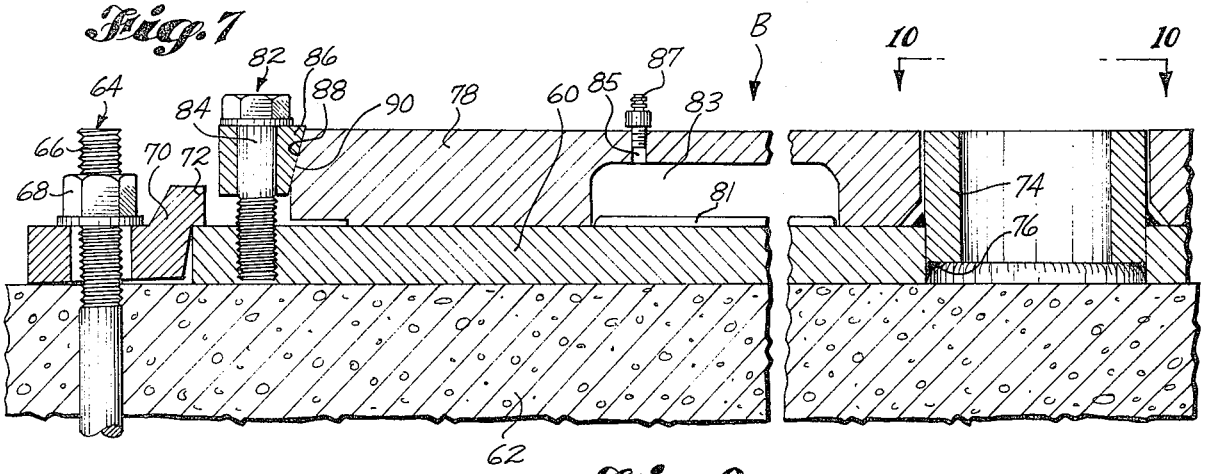
Fig. 9
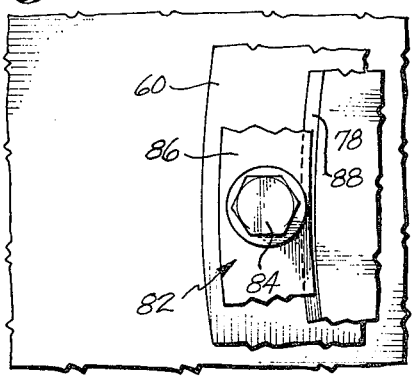
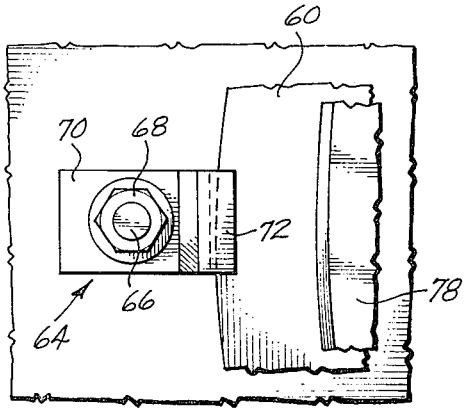
Fig. 8
Fig. 10
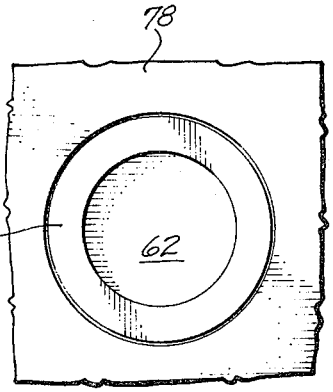
Fig. 6
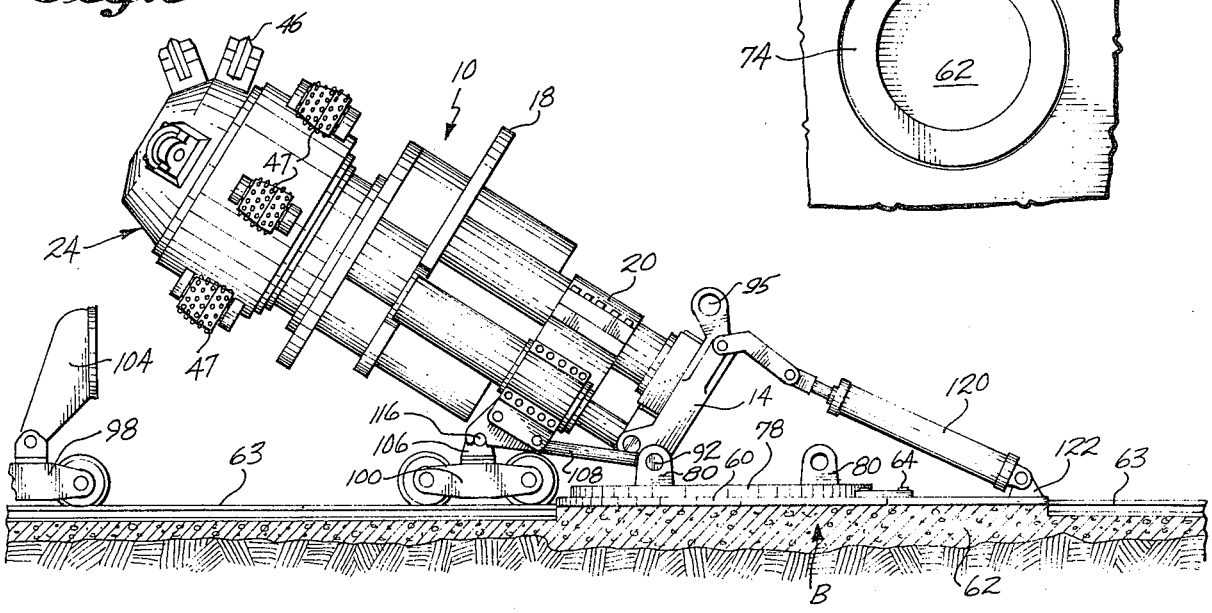

METHOD AND APPARATUS FOR ESTABLISHING THE DRILLING LINE OF AN OVERHEAD BORING MACHINE

BACKGROUND OF THE INVENTION

1. Field of the Invention

This invention relates to a base structure or a boring machine of a type adapted to bore upwardly from an underground location. More particularly, it relates to a base structure adapted to permit azimuthal adjustment of the boring line. It also relates to a method for establishing the boring line of an overhead boring machine.

2. Description of the Prior Art

Machines for mechanically boring a hole or tunnel upwardly through an earth formation from an underground location are well-known. Examples of such known machines are disclosed in U.S. Pats. No. 3,304,033, granted Feb. 14, 1967 to R. L. Thompson; U.S, Pat. No. 3,490,546, granted Jan. 20, 1970 to J. S. Hattrup et al.; U.S. Pat. No. 3,604,754, granted Sept. 14, 1971 to G. Kampf-Emden Hosel et al; U.S. Pat. No. 3,780,815, granted Dec. 25, 1973 to C. D. Barron et al. and U.S. Pat. No. 3,840,272, granted Oct. 8, 1974 to C. H. Crane et al.

The machines disclosed by the above patents are supported on base structures which are rigidly affixed to the ground surface of the underground location. The machines are pivotally mounted to their base structures in such a manner that the machines can be tilted at any angle along a 90° vertical arc of circle to establish a drilling line. A distinct disadvantage of such mounting arrangement is that the drilling line generally cannot vary outside of a single 90° arc of vertical circle once the base is assembled on the tunnel floor. Some base structures also enable a second arc of vertical circle, perpendicular to the first, to be established. Nevertheless, the azimuthal position of the boring machine's drilling line must be selected ahead of time so that the base assembly may be positioned on the ground surface accordingly. If the base assembly is misaligned, or if a change in the azimuthal position of the drilling line is desired after the base assembly has been emplaced, the entire assembly must either be taken apart and moved, or a new base structure assembled. Such a process is both time-consuming and costly.

SUMMARY OF THE INVENTION

A primary object of the present invention is to provide a base structure for an upward boring machine which enables positioning of the machine along any azimuthal position above the horizontal subsequent to installation of the base structure on the ground surface and the machine on the base structure.

A further object of the present invention is to provide a rotatable base structure for an upward boring machine.

Another object of the invention is to provide a method for establishing the drilling line of a machine for boring upwardly from an underground location.

Yet another object of the present invention is to provide a method for establishing the drilling line of a machine for boring upwardly from an underground location along any desired azimuthal position above the horizontal.

To achieve these objects and in accordance with the present invention, a base structure is provided for a boring machine adapted to bore a hole upwardly from an underground location. The assembly includes a rotatable base member to which the boring machine is secured. Preferably, mounting lugs are provided on the base member for securing the boring machine thereto, and at least one axially adjustable member is provided between the base member and the boring machine for raising and lowering the boring machine along an arc of vertical circle relative to the base member.

In preferred form a bed member is rigidly affixed relative to the ground surface of the underground location. Such bed member has a centrally disposed shaft extending upwardly therefrom. The rotatable base member is mounted on the bed member for rotation about the central shaft. Anchor means are provided about the periphery of the rotatable base member and are adapted to adjustably secure the base member against rotation relative to the bed member.

Preferably, a concrete foundation is formed on the ground surface of the underground location, and the bed member is secured thereto, such as by rock bolt means.

To perform the method of the present invention, the boring machine is transported through a tunnel to the underground location in a generally horizontal position. A lower frame portion of the machine is then pivotally secured to the rotatable base member, and the boring machine is then raised along a selected arc of vertical circle relative to the base member and is then fixed in position relative to the base member. The base member, with the machine attached thereto, is rotated to establish the azimuth of the drill line. Then, the base member is secured against further rotation relative to the bed member. In this manner, the drilling line of the boring machine may be established along any selected azimuthal position above the horizontal plane of the base assembly.

BRIEF DESCRIPTION OF THE DRAWINGS

FIG. 6 is a side elevational view of the boring machine in the process of being moved from its transport means onto an embodiment of the base structure of this invention;

FIG. 7 is a fragmentary sectional view taken through a portion of an illustrated embodiment of the base structure, substantially along line 7—7 of FIG. 4

FIG. 8 is a fragmentary top plan view of a rock bolt clamp shown clamping a fixed portion of the base structure to the floor of the tunnel;

FIG. 9 is a view like FIG. 8, but of an anchor bolt clamp used for securing a rotatable portion of the base structure relative to the fixed portion of the base assembly structure;

FIG. 10 is a fragmentary top plan view of the central shaft mounting the rotatable portion of the base structure for rotation relative to the fixed portion of the base structure;

DESCRIPTION OF THE PREFERRED EMBODIMENT

Figure 1:
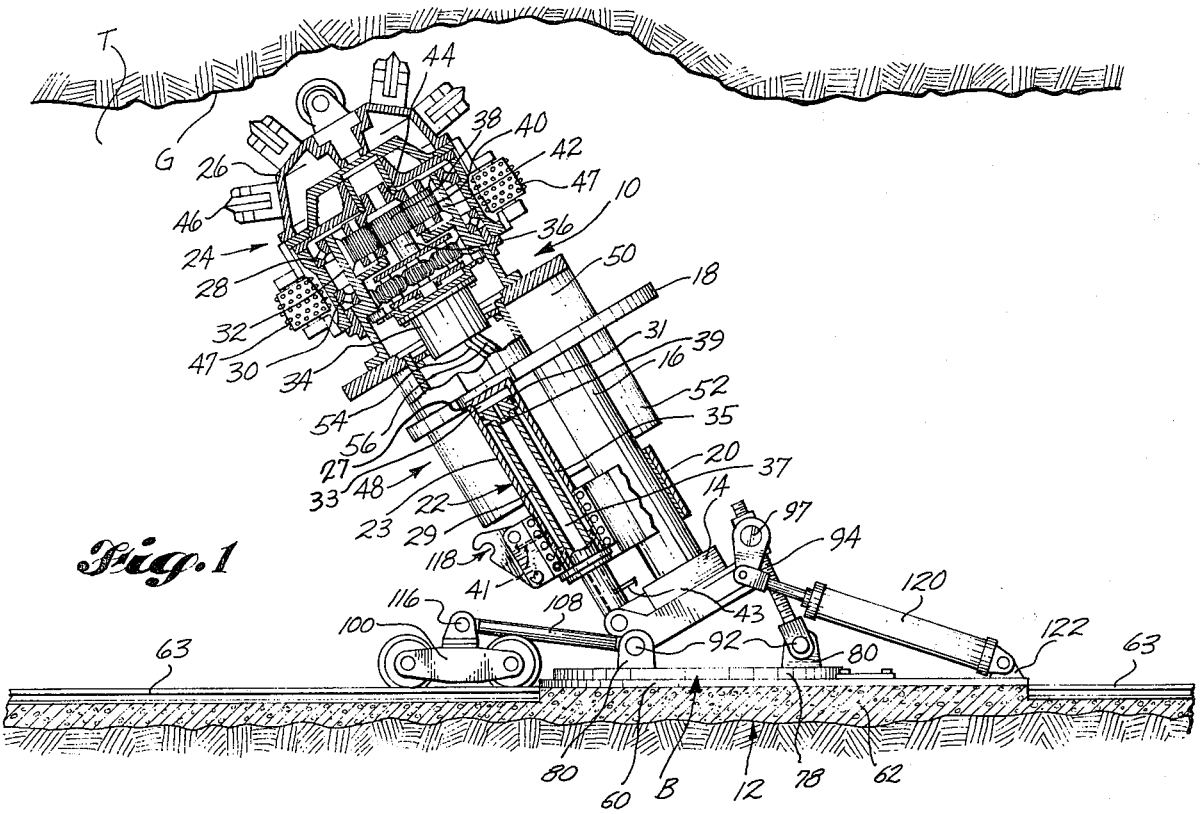
FIG. 1 is a side elevational view of a machine for boring upwardly through a ground formation, shown in the process of being set up on a base structure embodying the present invention.
Figure 2:
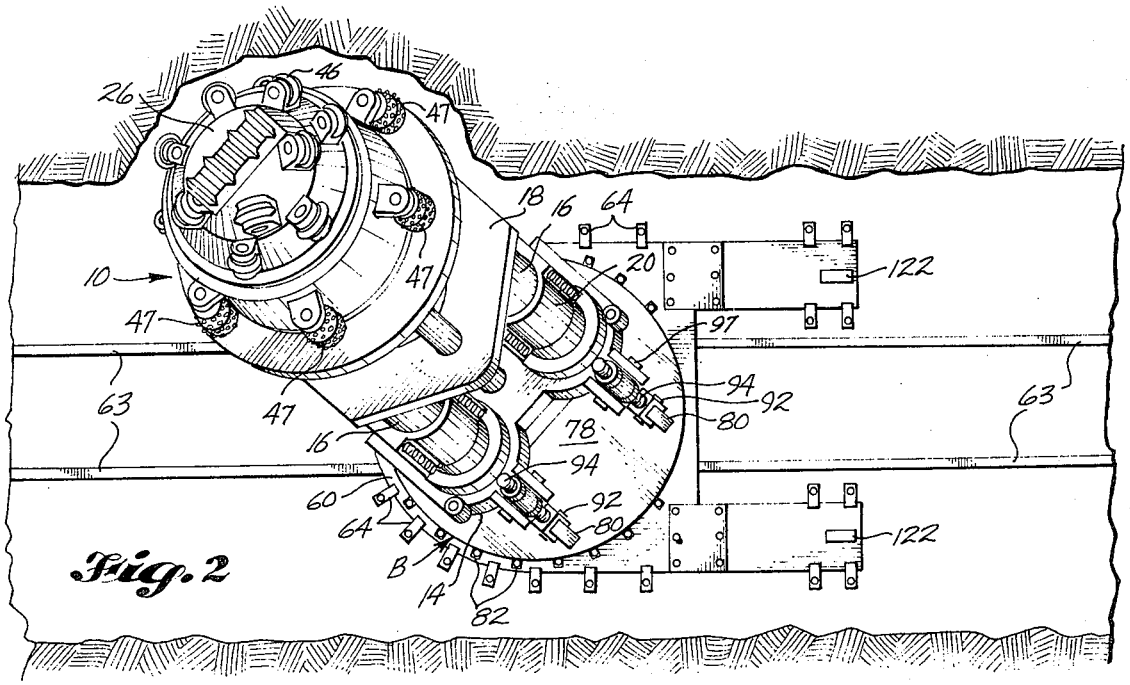
FIG. 2 is a top plan view of the machine shown in FIG. 1, illustrating the relationship of the base structure to the trackway in the tunnel, and showing the machine positioned to bore along an azimuthal position between alignment and perpendicular positions relative to the tracks.

Referring in particular to FIGS. 1 and 2, a base structure B of the present invention is provided for rigidly affixing a boring machine 10 to the floor 12 of a tunnel T.

Machine 10 comprises a lower end frame 14 which is pivotally secured to the base structure B in a manner to be hereinafter described. Guide column means, such as a pair of spaced apart guide columns 16, are connected to end frame 14 and project upwardly therefrom. The upper ends of guide columns 16 are connected to a holding table 18. A traveling cross frame 20 is mounted for up-and-down travel along the columns 16. Thrust ram means comprising at least one linear piston-cylinder motor 22 is interconnected between the end frame 14 and the traveling frame 20. Motors 22 are double-acting hydraulic cylinders and are operated for moving the traveling frame 20 relative to end frame 14.

In preferred form, each linear piston-cylinder motor 22 has an axially movable outer cylinder body 23 connected at its lower portion to traveling cross frame 20 and having an upper end wall 27. Disposed axially within outer cylinder body 23 is an immovable piston rod 29 having a piston head 31 secured to its uppermost end so as to define an end chamber 33 between piston head 31, cylinder body 23 and end portion 27 and a rod chamber 35 between piston rod 29 and cylinder body 23. Piston rod 29 is hollow and has an axially disposed passageway 37 defined therewithin. Interconnecting end chamber 33 to passageway 37 and passing through piston head 31 is a fluid passageway 39. Inlet-outlet tubes 41 interconnect rod chamber 35 to a source of motive fluid, such as hydraulic fluid, and inlet-outlet tubes 43 interconnect passageway 37 to a similar source of motive fluid. In operation, motive fluid is introduced into the passageway 37 and end chamber 33 via tubes 43 so as to increase the volume of end chamber 33 and thereby apply upward pressure against end wall. This moves cross frame 20 and the components attached thereto upwardly. To move cross frame 20 downwardly, motive fluid is introduced into rod chamber 35 via port 41, and the motive fluid in end chamber 35 is exhausted, so as to apply downward pressure against the bottom walls of rod chambers 35. Thus, cylinder body 23, cross frame 20 and the components attached thereto may be moved upwardly and downwardly as desired.

Machine 10 also includes a cutterhead assembly 24 comprising a drum-like cutterhead or cutter carrier 26 which is supported by combination bearings 28, 30 for rotation about a cutterhead support 32. Cutterhead support 32 is shown to be hollow and to house a hydraulic drive motor 34. The output shaft 36 of drive motor 34 is coupled to a sun gear 38 which drives a plurality of planet gears 40. Planet gears 40 also mesh with an internal ring gear 42 which is affixed to the cutterhead support 32. Planet gears 40 are mounted for rotation by stub axles which are connected to a rotatable carrier 44, carrier 44 being operatively connected with the rotatable cutter carrier 26.

A plurality of cutters, such as kerf cutting disc cutters 46 and rolling stabilizer cutters 47, are mounted on the cutter carrier 26 in the manner shown by FIGS. 1 and 2.

Machine 10 also includes a sectional support column 48 which is interconnected between the movable cross frame 20 and a tail section 50 of the cutterhead support 32. Preferably, each section 52 of the support column 48 includes means for coupling to the traveling cross frame 20 in such a manner that the support column 48 is restrained against rotation relative to cross frame 20. The worktable 18 includes means for holding the support column above it in fixed position during addition and removal of additional sections 52 of the support column 48 below the table 18. Motor 34 is provided with supply and return conduits 54, 56 for the hydraulic fluid.

During operation of the boring machine, the hydraulic motors 22 are used for pushing the work table 18, cross frame 20 and the support column 48 connected to frame 20 upwardly for advancing the cutterhead assembly 24 into the ground material G. Hydraulic motor 34 rotates the cutter carrier 26 during upward travel of the support column and cutterhead assembly. The disc cutters 46 cut concentric circular kerfs in the ground material G and also crush the material between kerfs, while the roller cutters 47 establish the gage of the tunnel and also stabilize the boring machine 10 to prevent undesired wobbling or other lateral movement. When the cross frame 20 has reached its upper position, the support columm 48 is connected to the worktable 18 and is disconnected from the traveling frame 20. Motors 22 are then operated to lower frame 20, and a new section 52 of the support column 48 is interconnected between frame 20 and the anchored portion of the support column 48. Then, the support column 48 is disconnected from table 18, and the motors 22 are used for again advancing the support column 48 and the cutter assembly upwardly.

The aforementioned U.S. Pat. No. 3,840,272 discloses in more detail a preferred boring machine and its operation, and the contents thereof are specifically incorporated herein by reference.

With particular reference to FIGS. 4 – 11, the base assembly structure B includes a steel bed member 60 (e.g. a plate member) which is rigidly secured relative to the ground surface of tunnel T. In the illustrated form, a concrete foundation 62 is permanently formed on the ground surface of tunnel T at the location where base structure B is to be placed. This provides a relatively horizontal and flat surface for base structure B. Preferably, foundation 62, as shown in FIG. 2, is flush with and extends laterally outward beyond the trackway 63, on both sides, to provide greater convenience in mounting machine 10 to base structure B, as hereinafter described in more detail.

Bed member 60 is secured to foundation 62 in any desired manner. In one embodiment, bed member 60 may be secured to foundation 62 by means of a plurality of rock bolt assemblies 64 disposed about the circumferential edge of bed member 60. As illustrated in FIGS. 4 – 10, each assembly 64 includes a rock bolt 66 which is imbedded in foundation 62, a nut 68 thread engaged about bolt 66, and a flange clamp 70 which loosely surrounds bolt 66 between nut 68 and the foundation 62. Flange clamp 70 overhangs the peripheral edge of bedplate 60 such that the overhanging portion 72 of clamp 70 engages the upper circumferential edge surface of bed member 60 when nut 68 is tightened against clamp 70, thus rigidly holding bed member 60 to foundation 62.

A shaft 74 projects upwardly from the center of bed member 60. Shaft 74 is rigidly affixed relative to the ground surface of tunnel T and is preferably secured to bed member 60, such as by welding at location 76. Alternatively, shaft 74 may extend into foundation 62 and be secured thereto.

A rotatable steel base member 78, preferably of circular configuration, is mounted atop bed member 60 for rotation about shaft 74. A plurality of mounting lugs 80, preferably of the clevis type, are mounted on the upper surface of base member 78 and serve for securing machine 10 to base member 78, as hereinafter described in more detail.

In order to readily rotate base member 78, the bottom portion of base member 78 may be provided with an annular recess 81 surrounding shaft 74. Recess 81 may include a plurality of air cells 83 recessed into base member 78 to a greater extent than the rest of recess 81. In this manner, cells 83 are separate from each other yet are interconnected by the annular air space of recess 81. An inlet orifice 85 passes through the upper portion of base member 78 into at least one of the air cells 83. A valve 87 is disposed within orifice 85 and enables air or any other suitable fluid to be introduced into cells 83 and hence into recess 81. This enables base member 78 to then be easily rotated even when machine 10 is secured thereto. When base member 78 has been rotated to its desired position, the air supply is ceased. The base member 78 is then secured against rotation as described herebelow.

To secure base member 78 against rotation relative to bed member 60, a plurality of anchor means 82 may be provided about the peripheral edge of base member 78. In the embodiment illustrated in FIGS. 4–10, the anchor means 82 comprises a clamp ring 86 and a plurality of anchor bolt 84 which pass through ring 86 and thread engage with bed member 60. Clamp ring 86 is adapted to compressably engage the peripheral edge of base member 78 when bolts 84 are tightened downwardly into bed member 60. In one form, the upper circumferential edge portion 88 of base member 78 is chamfered inwardly toward shaft 74, while the edge portion 90 of clamp ring 86 opposite chamfer 88 is beveled to form a similarly angled surface. Therefore, when bolts 84 are tightened into bed member 60, edge portion 90 engages edge portion 88 in a face-to-face manner to force base member 78 against bed member 60. Upon loosening bolts 84 base member 78 becomes free to rotate about shaft 74.

Figure 11:
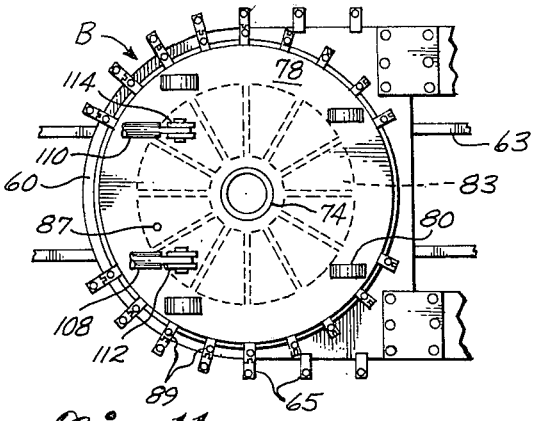
FIG. 11 is a fragmentary top plan view of the base structure of the present invention illustrating an air bearing for the base member.
Figure 12:
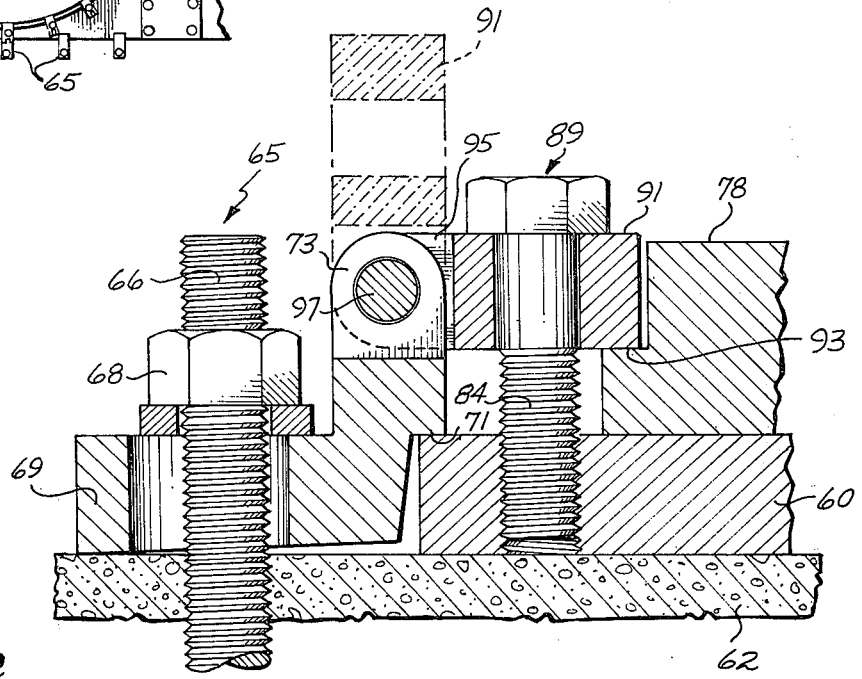
FIG. 12 is a sectional view taken substantially along line 12—12 of FIG. 13, showing a portion of a second embodiment of the anchor means and rock bolt means utilized to secure the fixed and rotatable portions of the base structure of the present invention to the tunnel floor.
Figure 13:
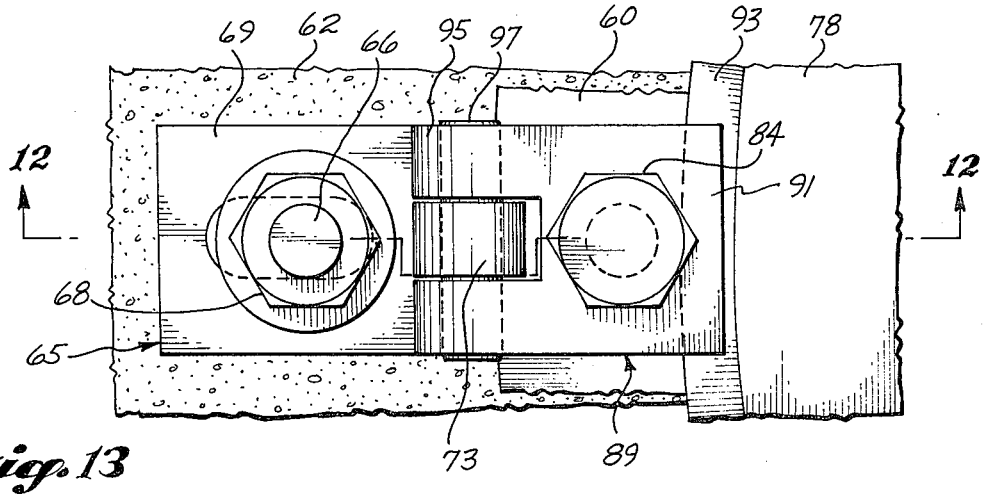
FIG. 13 is a fragmentary top plan view of the anchor means and rock bolt means illustrated in FIG. 12 and utilized to secure the fixed and rotatable portions of the base structure of the present invention to the tunnel floor.

An alternate means for securing bed member 60 to foundation 62 and base member 78 to bed member 60 is illustrated in FIGS. 11–13. With reference thereto, a plurality of rock bolt assemblies 65 are disposed about the circumferential edge of bed member 60. Each assembly 65 includes a rock bolt 66 which is imbedded in foundation 62, a nut 68 thread engaged about bolt 66, and a flange clamp 69 which loosely surrounds bolt 66 between nut 68 and foundation 62. Flange clamp 69, as in the previous embodiment, overhangs the peripheral edge of bedplate 60 such that the overhanging portion 71 of clamp 69 engages upper circumferential edge surface of bed member 60 when nut 68 is tightened against clamp 69, thus rigidly holding bed member 60 to foundation 62. Flange clamp 69 also includes a lug portion 73 located above the overhanging portion 71. Each lug portion 73 has an orifice passing therethrough.

To secure base member 78 against rotation relative to bed member 60, a plurality of anchor means 89 are provided about the peripheral edge of base member 78 and are aligned with rock bolt assemblies 65. In this particular embodiment, each anchor means 89 includes an anchor bolt 84 thread engaged with bed member 60, and a clamp 91 disposed about bolt 84 and adapted to compressably engage the peripheral edge of base member 78 when bolt 84 is tightened downwardly into bed member 60. A circumferential edge portion 93 of base member 78 may be notched inwardly toward shaft 74 so that the clamp 91 may engage edge portion 93. The end portion 95 of each clamp 91 which is located furthest from base member 78 is in the form of a clevis and is engaged about either side of lug portion 73 of flange 69. The clevis end portion 95 has orifices passing therethrough and is aligned with the orifice in lug portion 73. A hinge pin 97 interconnects clevis portion 95 of clamp 91 to lug portion 73 of flange 69 so that clamp 91 may be rotated upwardly away from base member 78. When it is wished to rotate base member 78, each bolt 84 is loosened until the clamping pressure is removed from base member 78. After the base member 78 has been rotated into its desired position, each bolt 84 is tightened downwardly through its clamp 91 into bed member 60 so as to compress clamp 91 against edge portion 93 and thereby secure base member 78 against rotation.

As previously mentioned, rotatable base member 78 supports and carries the boring machine 10. In preferred form, two of the mounting lugs 80 are pivotally secured to end frame 14 of machine 10 by positioning a pivot pin 92 through the mounting lugs 80 and corresponding openings 81 (FIG. 5) in end frame 14. To raise and lower the boring machine 10 along an arc of vertical circle, at least one and preferably two axially-adjustable members 94 interconnect the remaining mounting lugs 80 with end frame 14. In preferred form, each member 94 comprises a turnbuckle pivotally connected at one end to a mounting lug 80 and pivotally connected at its other end to frame 14. Openings 95 in the end frame 14 receive pivot pins 97 which pivotally connect the upper ends of turnbuckles 94 to end frame 14. By adjusting the lengths of turnbuckles 94, the angle of machine 10 relative to the base member 78 may be adjusted as desired along a 90° arc of vertical circle.

In addition, according to the invention base member 78 may be rotated to any selected azimuth angle. Thus, by raising machine 10 and rotating base member 78, the drilling line for boring machine 10 may be established at any azimuthal position above the horizontal plane of base assembly B.

In the illustrated embodiment and with particular reference to FIGS. 1–6, boring machine 10 is transported to an underground drilling location along a trackway 63 disposed on the ground surface of tunnel T. To achieve this, boring machine 10 is carried in an essentially horizontal position on trucks 98 and 100 which travel along trackway 63 on flanged wheels 102. Truck 98 includes a support carrier 104 for supporting the cutterhead portion 24 of machine 10, while truck 100 has a carrier support 106 for support the end frame 14 of machine 10.

After machine 10 has been transported to base assembly B, two spacing rods 108, 110 are interconnected between truck 100 and lugs 112, 114 on base member 78. Rods 108, 110 prevent movement of truck 100 during the process of mounting machine 10 to base assembly B and also establish proper spacing of the pivot pin openings. It should also be noted that support carrier 106 on truck 100 includes two horizontal pin portions 116 extending outwardly therefrom on either side. Pins 116 engage slots 118 of machine 10 to support the end frame 14 of the machine.

To mount machine 10 onto base assembly B, hydraulic cylinders 120, or some other length-adjustable members, are secured at one end to lugs 122 which are disposed on the opposite side of base assembly B from the horizontally positioned boring machine 10. The other ends of members 120 are extended over assembly B and connected to the upper portion of end frame 14 of horizontal machine 10, end frame 14 having been positioned to overhang base assembly B. The lengths of members 120 are then shortened a sufficient amount to remove the weight of machine 10 from truck 98, and truck 98 is moved away from machine 10.

The lengths of members 120 are then further shortened to pivot boring machine 10 about pins 116 on truck 100. When the lowermost edge portions of end frame 14 come into alignment with lugs 80, as shown in FIG. 6, pin members 92 are inserted to connect this end of frame 14 to the lugs 80. The lengths of members 120 are again shortened until notches 118 disengage from pins 116. Upon such disengagement, turnbuckles 94 are secured to the two remaining lugs 80 and to the upper end of frame 14, as shown in FIG. 1. The rods 108, 110 are then disengaged from lugs 112, 114, and truck 100 is moved away from base assembly B. After disengaging length-adjustable members 120 from the frame 14 of machine 10, machine 10 is ready to be positioned for drilling.

Figure 3:
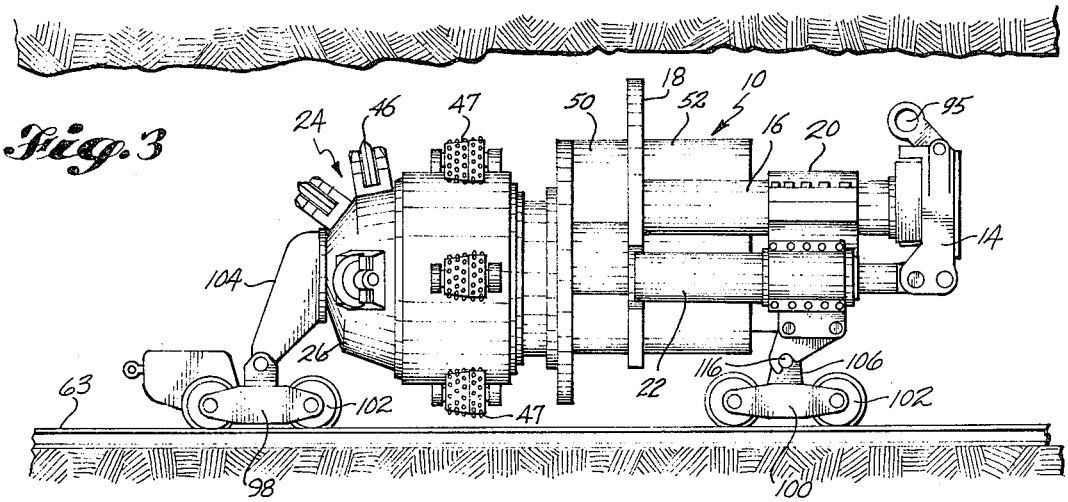
FIG. 3 is a side elevational view of the boring machine being transported through a tunnel to the underground boring site.
Figure 4:
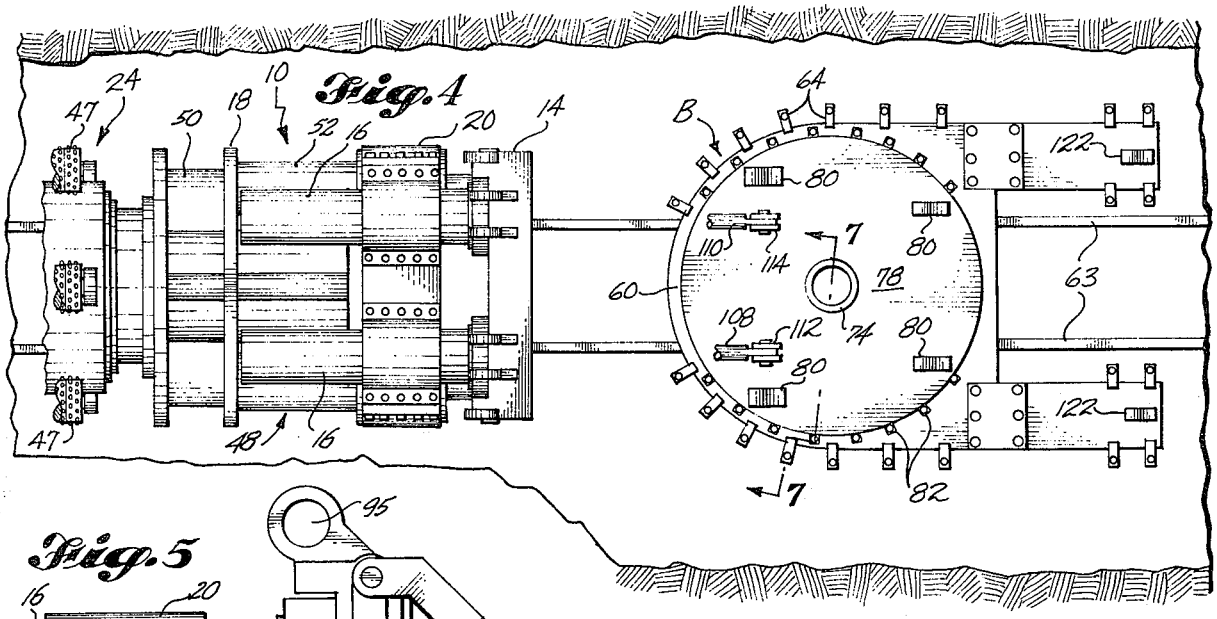
FIG. 4 is a top plan view of the boring machine approaching the boring site, including a top plan view of an embodiment of the base structure of the present invention.
Figure 5:
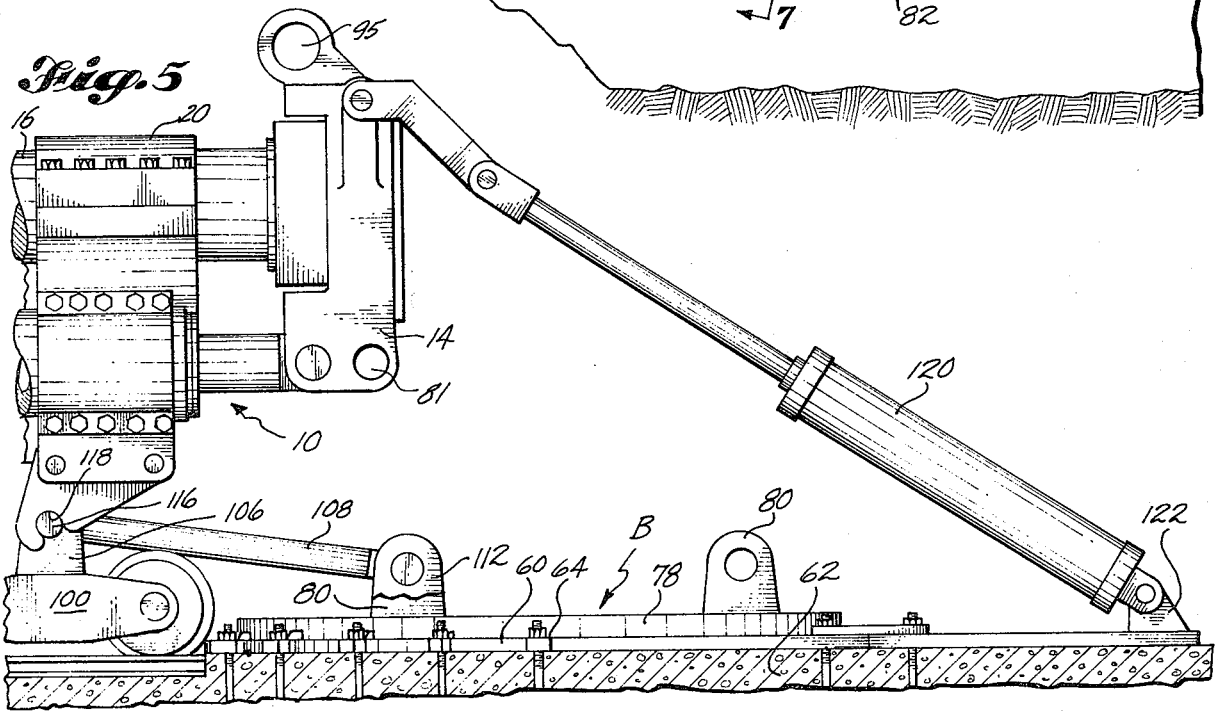
FIG. 5 is a fragmentary side elevational view showing the boring machine being readied for movement from its transport means onto an embodiment of the base structure of this invention.

FIGS. 3 and 6 show some of the cutter members 46 removed. These members 46 are added to the cutterhead prior to complete elevation of the machine.

When the desired drilling line has been ascertained, the boring machine 10 is raised along an arc of vertical circle by shortening turnbuckles 94, and the base member 78 is rotated to the proper azimuth. When machine 10 has reached the proper azimuthal position, thereby establishing the desired drilling line, anchor means 82 are tightened to secure base member 78 to bed member 60 and thus immobilize it against further rotation. Thrust rams 22 then advance the boring machine 10 along the established drilling line while cutter carrier 26 is rotated, thereby drilling away the material ahead of boring machine 10 along the desired drilling line.

From the above, it can be seen that the present invention enables the implacement of a base assembly for an upward boring machine without having to first predetermine the drilling line of the boring machine. Thus, with the present invention, any upward drilling line may be selected after the machine has been secured to its base assembly due to the fact that the boring machine may be brought to any desired azimuthal position above the plane of the base assembly structure.

As earlier stated, the upper surface of the concrete foundation 62 is substantially flush with the upper surfaces of the two tracks which form trackway 63. Wood strips or the like may be set into the concrete on the side of the tracks on which the wheel flanges are situated. Following use of the machine, and its removal from the underground boring site, the base structure is moved. The wood strips are also removed from the concrete so that the concrete pad or foundation can be left in place and it will not interfere with further use of the tracks.

It will be understood that the invention may be embodied in other specific forms without departing from the central characteristics thereof. The present illustrations and embodiments, therefore, are to be considered in all respects as illustrative and not restrictive, and the invention is not to be limited to the details given herein but may be modified within the scope of the appended claims.

What is claimed is:

1. An underground base structure for a boring machine of a type having a lower mounting end and an upper boring head end, and which is adapted to bore a sloping hole upwardly through ground formation above the base structure and the boring machine, said base structure comprising:

a rotatable substantially flat base member;

means for mounting said base member on the floor at an underground location, for rotation about a generally vertical axis;

upstanding mounting lug means on said base member for use in attaching the lower mounting end of a boring machine of the type described onto said base member, so that such boring machine would in use extend upwardly generally vertically above said base member and a downward continuation of the drilling line of such boring machine would intersect said base member; and means for affixing said base member, and a boring machine attached thereto, in a selected azimuthal position relative to the floor, to establish the azimuth of the drilling line of such boring machine.

2. The structure according to claim 1, wherein said means for affixing said base member, and a boring machine attached thereto, in a selected azimuthal position comprises anchor bolt means adapted to secure said base member in a selected rotational position relative to the floor of said underground location.

3. The structure according to claim 2, wherein said anchor bolt means comprises a plurality of anchor bolts positioned about the periphery of said base member, and clamp means on said anchor bolts adapted to secure said base member relative to said floor.

4. The structure according to claim 1, further comprising lift means adapted to position and affix a said boring machine along a selected arc of vertical circle relative to the plane of said base member, said lift means comprising at least one length-adjustable member which in use has one end thereof pivotally connected to such boring machine and its opposite end pivotally connected to said base member.

5. The structure according to claim 1, wherein said means for affixing said base member, and a boring machine attached thereto, in a selected azimuthal position includes a bedplate rigidly affixed relative to the ground surface of said underground location, and a shaft mounting said base member for rotation relative to said bedplate.

6. The structure according to claim 5, wherein said means for affixing said base member, and a boring machine attached thereto, in a selected azimuthal position further includes an anchor means adapted to secure said base member to said bedplate in a selected rotational position.

7. The structure according to claim 6, further comprising a concrete foundation permanently emplaced on said ground surface, with said bedplate being rigidly affixed to said foundation.

8. The structure according to claim 1, further comprising a trackway for transporting a boring machine to said underground location extending through the mounting location for said machine below the rotatable base member.

9. A base structure for a boring machine adapted to bore a hole upwardly from an underground location, of a type having a lower mounting end and an upper boring head end, said base structure comprising:

a bedplate rigidly affixed relative to the ground surface of said underground location;

a base member mounted on said bedplate for rotation about a generally vertical axis;

mounting lugs disposed on said base member to which the lower mounting end of said boring machine is attachable;

anchor means adapted to adjustably secure said base member to said bedplate in a selected rotational position; and lift means secured to said base member and adapted to position and affix said boring machine generally vertically above said base member along a selected arc of vertical circle relative to the plane of said base member when said boring machine is attached to said mounting lugs, thereby enabling said base member, and said boring machine attached thereto, to be affixed in a selected azimuthal position.

10. The structure according to claim 9, wherein a shaft is rigidly secured to the central portion of said bedplate and projects upwardly therefrom, said base member being rotatable about said shaft.

11. The structure according to claim 9, wherein said mounting lugs are rotatably attached to said boring machine and said lift means comprises at least one axially-adjustable member secured at one end to one of said mounting lugs and securable at its other end to the end frame of said boring machine.

12. The structure according to claim 9, wherein said anchor means comprises a plurality of anchor bolts disposed about the periphery of said rotatable base member and adapted to secure said base member to said bedplate to prevent relative rotation therebetween.

13. The structure according to claim 12, wherein the upper peripheral edge portion of said base member is chamfered inwardly toward the center thereof, and wherein each said anchor bolt includes a flange clamp disposed therearound having a beveled edge for face-to-face engagement with the chamfer of said rotatable base member.

14. A method of establishing the drilling line of a machine for boring upwardly from an underground location, of a type having a lower mounting end and an upper boring head end, said method comprising:

transporting said machine in generally horizontal position to said location;

securing the lower mounting end of said machine to a base member that is rotatable about a vertical axis;

raising said machine along a selected arc of vertical circle relative to said base member;

rotating said base member, with said machine attached thereto, to a selected azimuth; and securing said base member against rotation relative to the ground surface of said underground location, thereby establishing the drilling line of said boring machine along a selected azimuthal position.

15. The method according to claim 14, wherein said boring machine is pivotally secured to a plurality of mounting lugs disposed on said rotatable base member, and said boring machine is raised along a selected arc of vertical circle relative to said base member by at least one length-adjustable member interconnecting said base member and said boring machine.

16. The method according to claim 14, wherein said base member is secured against rotation relative to said ground surface by a plurality of anchor bolts disposed about the periphery of said base member.

17. The method according to claim 14, wherein said base member is rotated about a centrally disposed shaft which projects upwardly from a bedplate fixidly secured relative to said ground surface, said base member being mounted for rotation on said bedplate.

18. A method of establishing the drilling line of a machine for boring upwardly from an underground location, of a type having a lower mounting end and an upper boring head end, said method comprising:

positioning a base member which is rotatable about a vertical axis at the underground location;

transporting said machine in an essentially horizontal position to said location;

securing the lower mounting end of said boring machine to the rotatable base member;

placing said boring machine at a selected azimuthal drilling position by raising said boring machine and rotating said base member until said boring machine has reached said azimuthal drilling position; and securing said base member against rotation relative to the ground surface of said underground location, thereby establishing the drilling line of said boring machine along the selected azimuthal position.

19. A method of drilling upwardly from an underground location comprising:

permanently forming a concrete foundation on the ground surface of said underground location;

rigidly mounting a bedplate on said formation, said bedplate having a centrally disposed shaft projecting upwardly therefrom, said shaft having a substantially vertical axis;

mounting a rotational base member on said bedplate for rotation about said shaft and said substantially vertical axis;

securing a machine for boring upwardly onto said rotatable base member, to extend upwardly therefrom;

placing said boring machine in a desired azimuthal position for drilling by raising said machine along a selected arc of vertical circle and rotating said base member to a selected azimuth, thereby establishing the drilling line of said boring machine along said desired azimuthal position;

securing said base member against rotation relative to said bedplate; and advancing said boring machine along said drilling line while drilling away the material ahead of said machine.

20. The method according to claim 19, wherein said base member is secured against rotation relative to said bedplate by a plurality of anchor bolts circumferentially disposed about said base member.

21. The method according to claim 19, wherein said bedplate is mounted to said foundation by a plurality of rock bolts, each said rock being removably imbedded in said foundation and having a flange member engaging the upper peripheral edge surface of said bedplate.

22. The method according to claim 19, wherein said boring machine is pivotally secured to a plurality of mounting lugs disposed on said rotatable base member, there being at least one length-adjustable member interconnecting said base member and said boring machine for raising said machine along said selected arc of vertical circle relative to said base member.

* * * * *